US005931341A

United States Patent [19]

Bittermann

[11] Patent Number: 5,931,341

[45] Date of Patent: Aug. 3, 1999

[54] ADJUSTABLE HIGH SPEED LID DROPPER

[75] Inventor: Karl Heinz Bittermann, Union City, Calif.

[73] Assignee: Wild Horse Industrial Corporation, Hayward, Calif.

[21] Appl. No.: 08/970,914

[22] Filed: Nov. 14, 1997

[51] Int. Cl.[6] ..... B65G 59/00

[52] U.S. Cl. ..... 221/222; 221/241; 221/242; 221/282; 414/900; 414/797.7

[58] Field of Search ..... 221/221, 222, 221/223, 241, 242, 282; 414/900, 797.7

[56] References Cited

U.S. PATENT DOCUMENTS

| | | | |
|---|---|---|---|
| 2,184,029 | 12/1939 | Wicklund . | |
| 3,253,722 | 5/1966 | De Gear . | |
| 3,272,384 | 9/1966 | Edwards | 221/221 |
| 3,426,941 | 2/1969 | Hovekamp . | |
| 3,674,160 | 7/1972 | Gutowski . | |
| 3,712,483 | 1/1973 | Messervey . | |
| 3,776,420 | 12/1973 | Melind . | |
| 4,243,153 | 1/1981 | Mitchell . | |
| 4,426,017 | 1/1984 | Ficker et al. | 221/241 |
| 4,558,802 | 12/1985 | Molison . | |
| 4,623,057 | 11/1986 | Langenberg . | |
| 5,113,636 | 5/1992 | Mihara et al. . | |
| 5,154,315 | 10/1992 | Dominico et al. . | |
| 5,476,362 | 12/1995 | Kobak et al. . | |
| 5,494,399 | 2/1996 | Pearce . | |
| 5,788,116 | 8/1998 | Bednar | 221/241 |

FOREIGN PATENT DOCUMENTS

| | | | |
|---|---|---|---|
| 25 19 183 | 11/1976 | Germany | 221/221 |

*Primary Examiner*—H. Grant Skaggs
*Attorney, Agent, or Firm*—Flehr Hohbach Test Albritton & Herbert; Todd A. Lorenz

[57] ABSTRACT

An automated, fully adjustable high speed lid dropper (10) including an upright set of guide rods (26) for supporting a stack of lids (12) above a conveyor (16), a set of three feed screws (62) for capturing the lowest lid at the bottom of stack (12) and feeding it onto a can positioned therebelow, a pivotal crank arm (64) for each feed screw for radially adjusting the feed screw, and a height adjustment mechanism (22) for vertically adjusting the position of the feed screws above the cans.

10 Claims, 7 Drawing Sheets

ADJUSTABLE HIGH SPEED LID DROPPER

TECHNICAL FIELD

The present invention pertains to automated equipment for separating a lid from a stack of lids and placing the lid onto a can for subsequent securement to the can.

BACKGROUND ART

A lid dropper is a piece of machinery that places lids on cans at a point along a conveyor after the cans have been filled with a product. It is known for automated equipment to place lids onto cans, such as for example paint can lids onto paint cans, by stacking lids in vertical alignment and holding the stacked lids in position by upright guide bars and a set of feed screws at the base of the guide bars, which support the stack of lids. The feed screws capture by rotation the lower lid from the stack and drop it onto an advanced can beneath the feed screws. The can is then indexed to a subsequent station where the lid is secured onto the can. The feed screws then rotate to capture the next bottom lid from the stack and drop it onto the next advanced can.

U.S. Pat. No. 2,184,029 of Wicklund discloses a can lid feeding unit that includes a set of four helical feed screw elements, each rotatably mounted on an inner end of a crank arm. A drive gear is associated with each feed screw element. Each crank arm is pivotal about a fixed shaft and is coupled to an intermediate gear, which couples each drive gear to an outer ring gear. A drive mechanism powers the ring gear to achieve rotation of each drive gear. The feed screw elements include a helical groove for capturing the rim of a lid and lowering the lid down onto a can.

U.S. Pat. No. 3,426,941 of Hovekamp discloses a similar feeder mechanism for stacked articles such as cans. Hovekamp includes in his apparatus a parallelogram linkage for each feed screw element and mounts a post at each feed screw element to support the stacked articles. Adjustment of the feed screw element also accomplishes simultaneous adjustment of the guide posts.

U.S. Pat. No. 3,712,483 of Messervey discloses a feeding device that utilizes an adjustable outer ring member that is coupled to a connecting rod linked to a swingable gear box housing that carries a grooved cam article advancing device. Rotation of the ring member swings the gear box housing and adjusts the relative spacing between the cam devices.

The foregoing patents are representative examples of prior art lid droppers. Unfortunately, however, these prior art lid droppers do not allow for the rapid and complete adjustment of the lid dropper assembly to accommodate lids having different diameters and cans of varying heights. Often, an entire production line must be shut down for a lengthy period of time while alterations are made to the lid dropper assembly or while alternative parts are installed, resulting in costly delays. Thus, there remains a need in the art for a fully-adjustable lid dropper that can be easily and rapidly adjusted to accommodate both different size cans and lids.

U.S. Pat. Nos. 5,476,362; 5,113,636; 5,494,399; 5,145,315; 4,623,057; 4,558,802; 4,243,153; 3,674,160; 3,253,722; and 3,776,420 are referenced for background purposes in order to put the present invention into proper perspective.

DISCLOSURE OF INVENTION

Briefly described, the lid dropper of the present invention comprises an upright rack means for supporting a stack of lids in a generally vertical orientation, a set of feed screws beneath the rack means for separating the lowest most lid from the stack of lids and dropping the separated lid onto a can positioned beneath the feed screws, and means for vertically adjusting the set of feed screws and rack means relative to a can postioned beneath the feed screws, in order to accommodate different height cans. A radially adjustable crank arm is provided for supporting each feed screw. Each crank arm is pivotally mounted in a manner permitting the feed screw supported thereby to be adjusted radially so that the spacing between the feed screws can be adjusted to accommodate different size lids. A thumb screw is operatively coupled to each crank arm to pivot the crank arm by rotation of the thumb screw and thereby adjust the radial position of the feed screw. The thumb screws are individually rotatable to achieve individual adjustment of the crank arms.

According to an aspect of the invention, means for holding each thumb screw in position after its associated crank arm is pivotally adjusted is provided in order to secure the feed screws at a selected spacing for a particular can lid.

According to another aspect of the invention, the rack means is radially adjustable to accommodate lids of varying sizes. Preferably, the rack means is radially adjustable independent of the feed screws.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
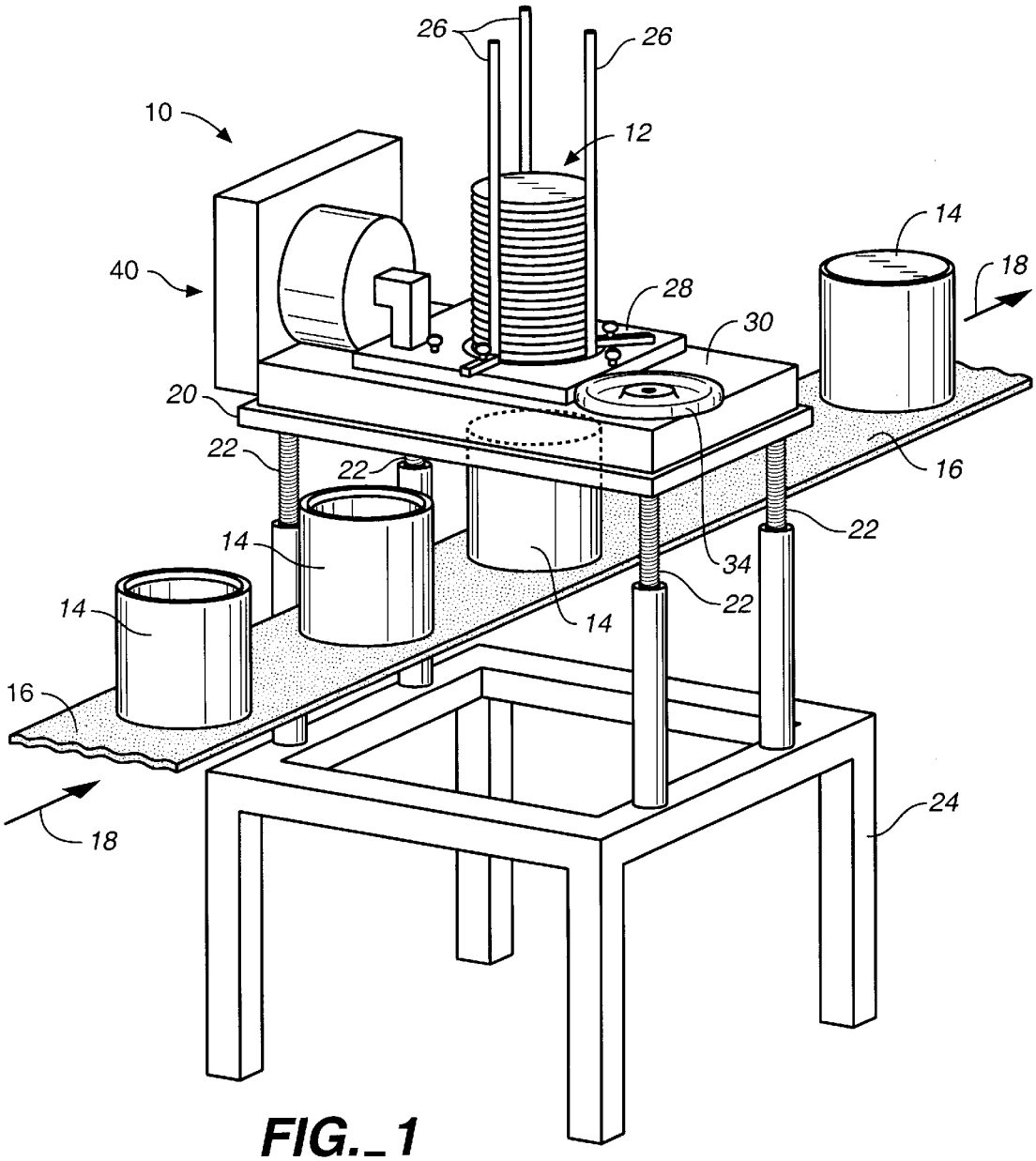
FIG. 1 is a pictorial view of the lid dropper of the present invention.

Referring to FIG. 1, the lid dropper 10 of the present invention is designed for placing lids 12 onto cans 14, which can both vary widely in size, in diameter and in height. The present invention is discussed with reference to paint cans, which can range in size from one gallon to one quarter pint. The range of lid sizes for these size cans is from approximately 6¾ inches for a gallon can to approximately 2½ inches for a one quarter pint can. Within each size lid there are variations in the actual lid size depending on the lid manufacturer. Thus, it is important that a lid dropper be infinitely and easily adjustable to accommodate different diameter lids. It should also be understood that the present invention is not meant to be limited to paint cans, and any use of the term "paint can" should be understood as a term of convenience and example.

Paint cans 14 are moved on a conveyor 16, in the direction of arrows 18, underneath a rectangular, vertically adjustable base plate 20, which is mounted on fourjack screws 22, which in turn are mounted on a base frame 24. Jack screws 22 are discussed in more detail later with reference to FIG. 5.

To guide the stack of lids 12 into position to be dropped onto paint can 14' positioned beneath the stack, three adjustable upright lid guide rods or bars 26 are radially adjustably mounted on a top plate 28. Guide rods 26 form a rack means for supporting the stack of lids.

A chain sprocket housing 30 is positioned between top plate 28 and base plate 20 and houses a chain and sprocket drive mechanism for turning jack screws 22 and thereby adjusting the height of lid stack 12 to accommodate paint cans of different heights. A large hand wheel 34, secured to one of the jack screws 22, is provided for raising and lowering base plate 20, and thus raising and lower lid stack 12.

A drive mechanism, indicated generally at 40, is coupled to a set of feed screws (not shown), which capture and drop the lowest lid onto the paint can positioned therebelow. Controls are provided, but not shown, which control operation of the feed screws in synchronization with movement of conveyor 16.

Figure 2:
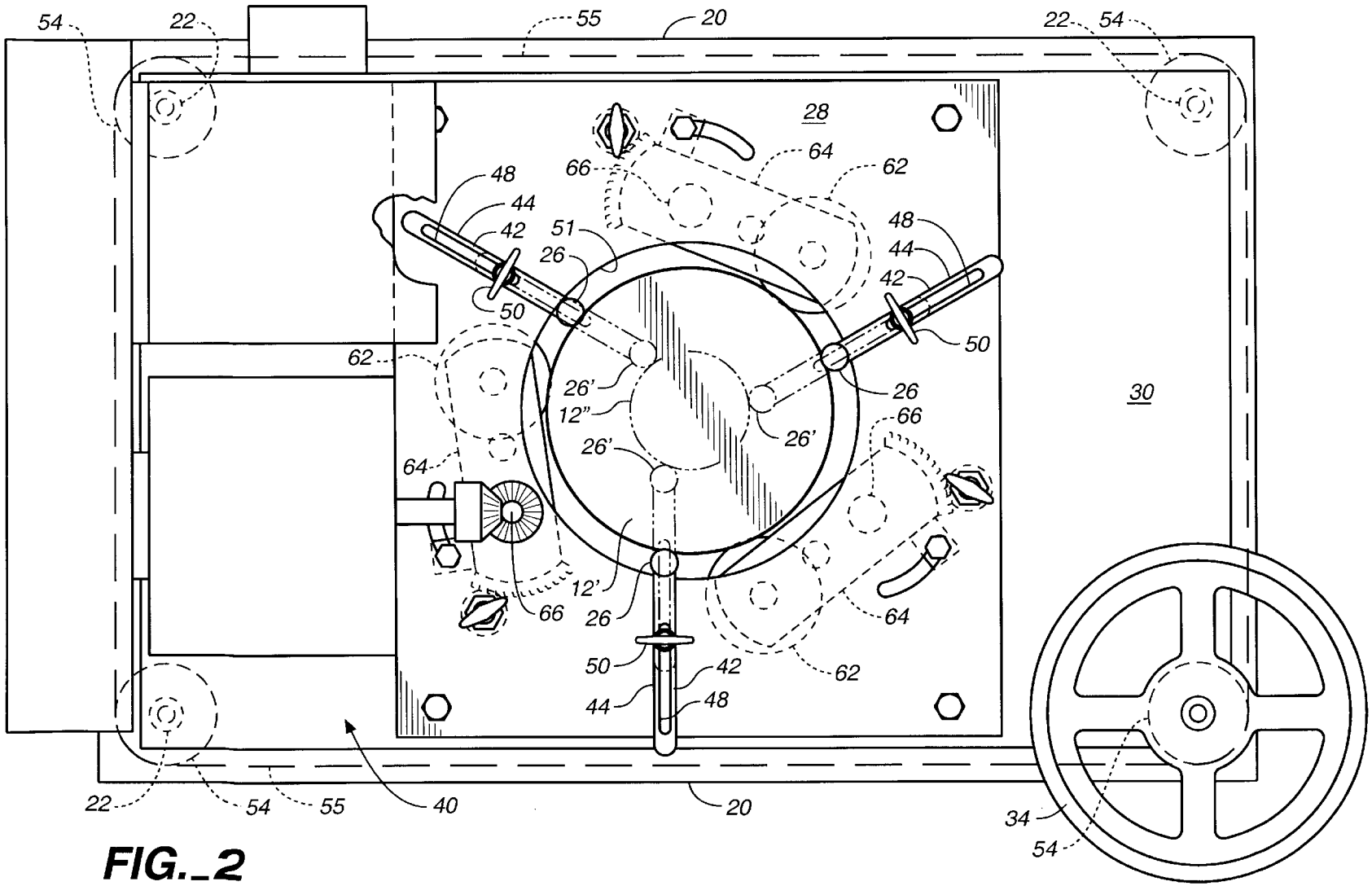
FIG. 2 is a top plan view of the lid dropper of FIG. 1.

Referring to FIG. 2, upright guide rods 26 are fitted into machined slots 42 on top plate 28. Guide rods 26 have horizontal extensions 44 welded to them that are sized to fit within slots 42 of top plate 28 and are slotted, as indicated at 48, to allow for radial adjustment to accommodate lids of different diameters. Thumb screws 50 are provided for securing guide rods 26 in radial position after adjustment of the guide rods. Top plate 28 includes a central opening 51, above which guide rods 26 extend. Guide rods 26 are shown in solid lines in radially outward positions supporting a large lid 12' and are shown in phantom lines in a radially inward position supporting a small lid 12".

Hand wheel 34 is drivingly coupled to jack screws 22 by means of sprockets 54 at each corner and a chain 55. Sprockets 54 are secured to their corresponding jack screws 22, and provide for simultaneous height adjustment of each jack screw, and therefor uniform adjustment of base plate 20.

Lid dropper 10 includes three feed screws 62, which are partially shown in FIG. 2. Each feed screw 62 is mounted on a pivotal crank arm 64, which pivots about shaft 66, which in turn is secured to top plate 28. Drive mechanism 40 includes a ring gear (not shown), which is drivingly coupled to a set of intermediate gears underneath each crank arm 64. Rotation of the ring gear causes feed screws 62 to rotate in unison, as discussed later.

Figure 3A:
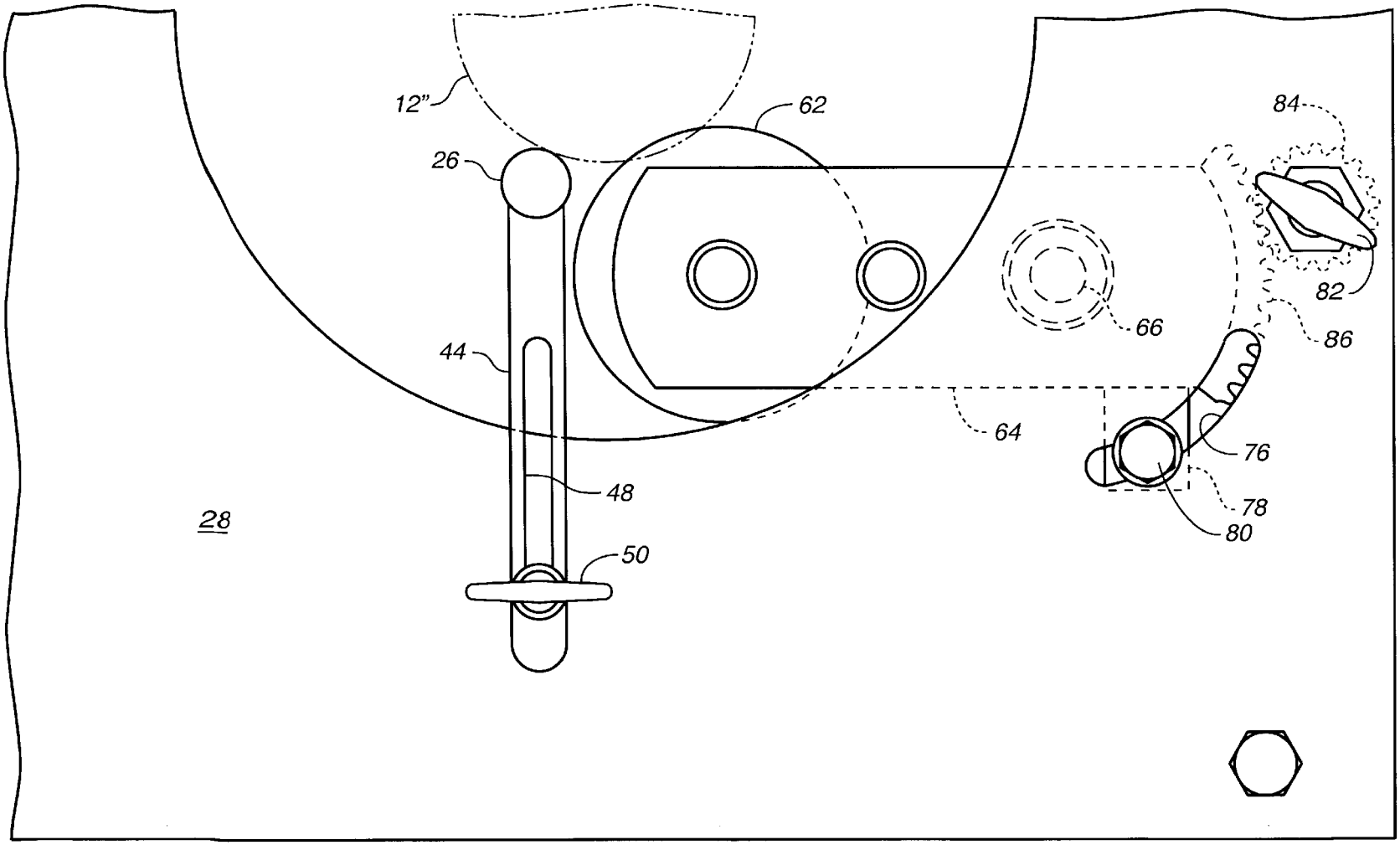
FIG. 3A is an enlarged top plan view of one of the radially adjustable guide rods and pivotally adjustable feed screws.

Referring to FIG. 3A, each crank arm 64 has associated with it an arcuate slot 76 in top plate 28. A side extension 78 from crank arm 64 mounts a hex head cap screw 80, which secures crank arm 64 in a selected pivoted position about shaft 66.

The position of crank arm 64 can be infinitely adjusted to radially position feed screws 62 in spaced relationship to support lids ranging from gallon size to quarter pint sizes. This is accomplished by turning thumb screw 82 rotatably mounted in top plate 28. Thumb screw 82 includes a spur gear 84, which mates with an arcuate rack gear segment 86 secured at the back of crank arm 64. Manual rotation of thumb screw 82 causes spur gear 84 to rotate the back end of crank arm 64, which in turn pivots crank arm 64 about shaft 66 and causes feed screw 62 to move radially in and out.

Figure 3B:
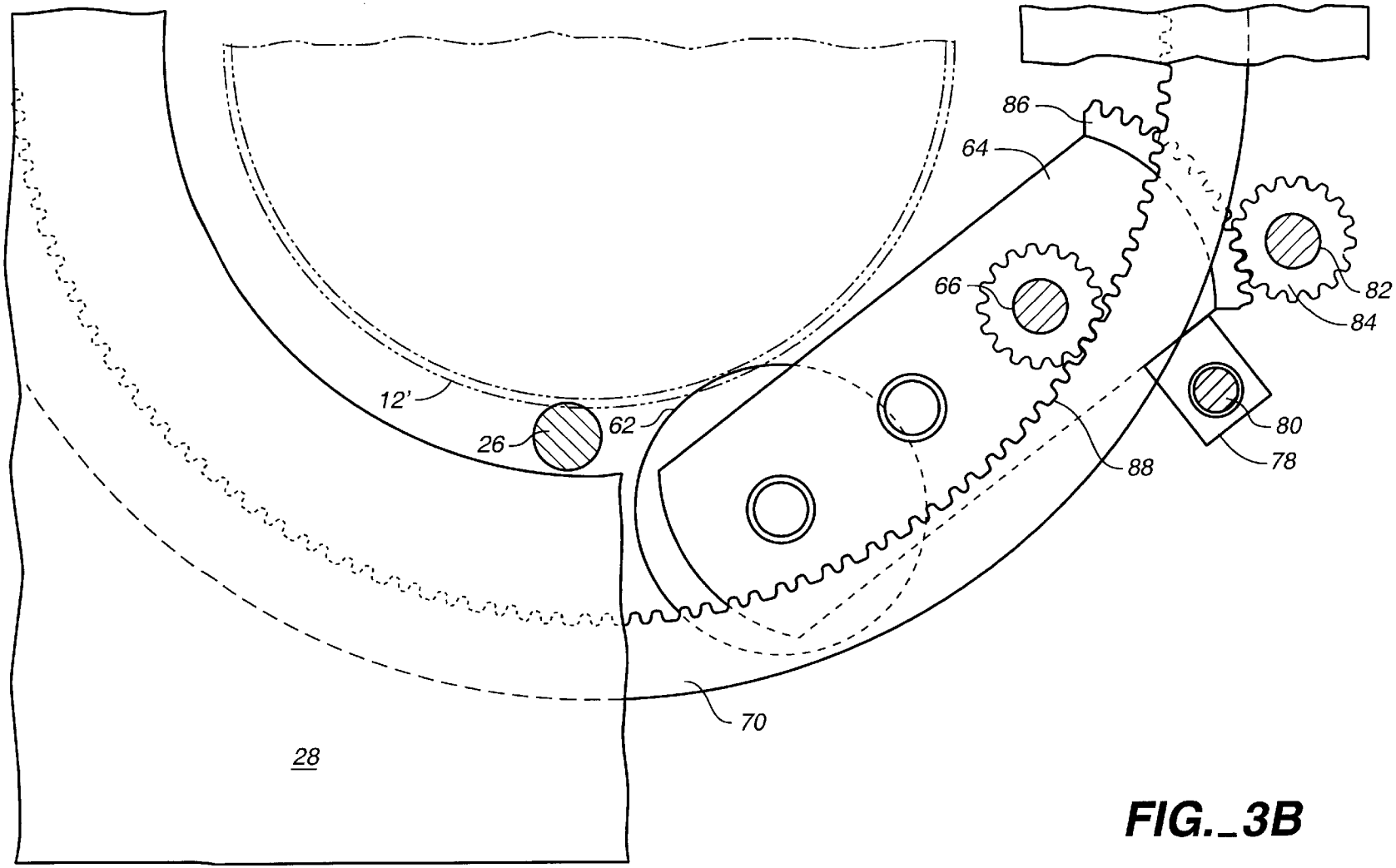
FIG. 3B is an enlarged top plan view of the pivotally adjustable feed screws in an outer position, with the top plate cut away.

Referring to FIG. 3B, a section of top plate 28 is cut away to show a pinion gear 88 rotatably mounted about shaft 66. Pinion gear 88 intermeshes with a ring gear 70, which extends around the outside of the three feed screws 62 and is rotatably supported within housing 30. Rotation of ring gear 70 causes the pinion gear 88 of each crank arm 64 to rotate. As discussed later, pinion gear 88 is coupled to a set of spur gears (not shown), which are coupled to feed screw 62.

When crank arm 64 is pivotally adjusted to move feed screw 62 radially in or out, the interengagement of the pinion gear 88 and ring gear 70 is not affected due to the positioning of shaft 66 relative to ring gear 70. Thus, radial adjustment of a feed screw does not interfere with the driving engagement between feed screw 62 and ring gear 70.

Figure 3C:
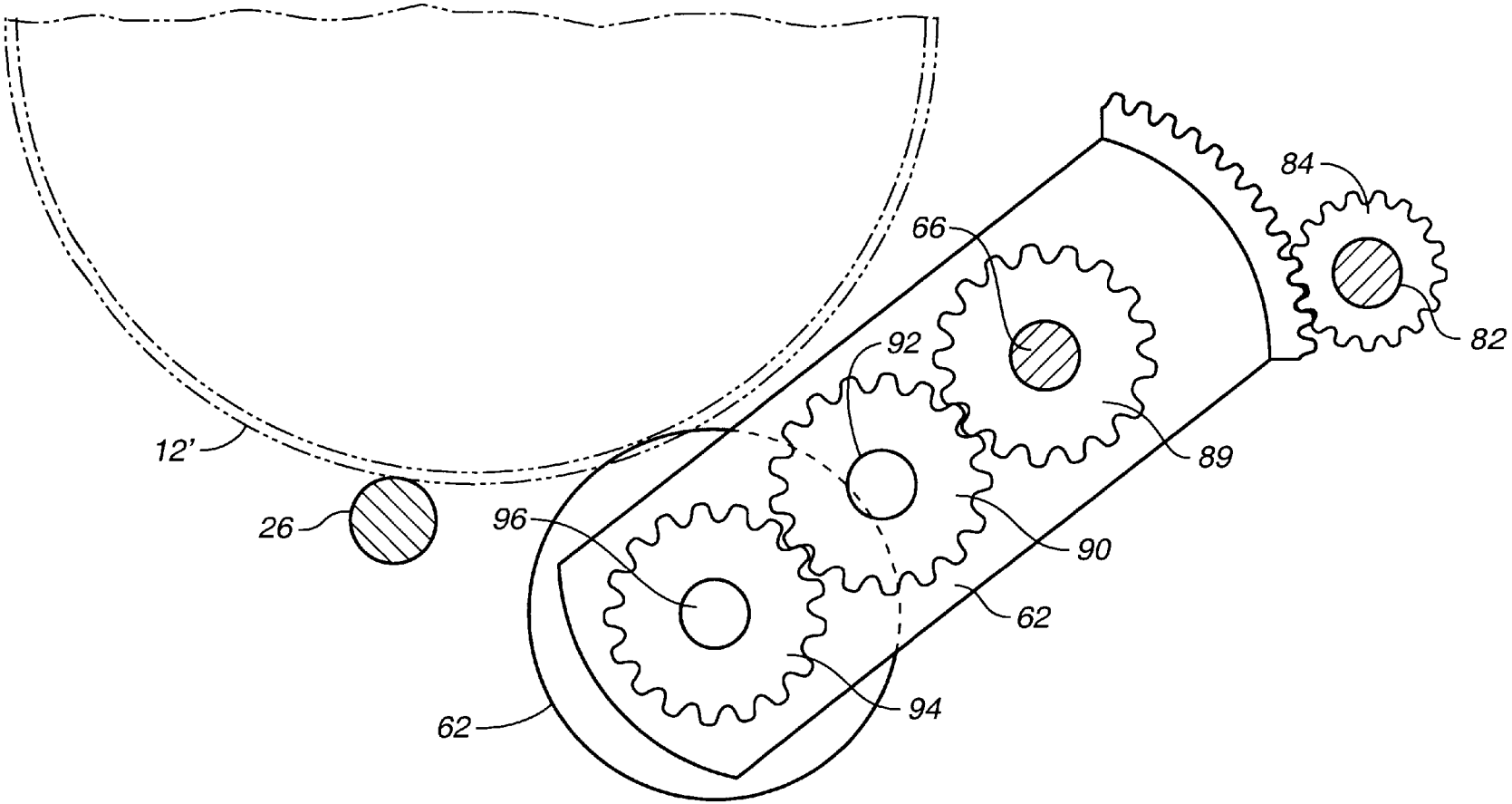
FIG. 3C is an enlarged top plan view of the spur gears drivingly coupling the ring gear to the feed screws.

Referring to FIG. 3C, a gear box mechanism is shown to include a driven gear 89, which is mounted on shaft 66. Driven gear 89 intermeshes with an idler gear 90, which is rotatably mounted on a short stub shaft 92 that is secured to crank arm 64. An output gear 94 intermeshes with idler gear 90 and is also mounted on a short shaft segment 96, which is secured to crank arm 64. The idler gear changes the direction of rotation so that the driven gear 89 and the output gear 94 rotate in the same direction. Each of the driven gears are in mesh with the one large ring gear that encircles the three pinion gears.

Figure 4:
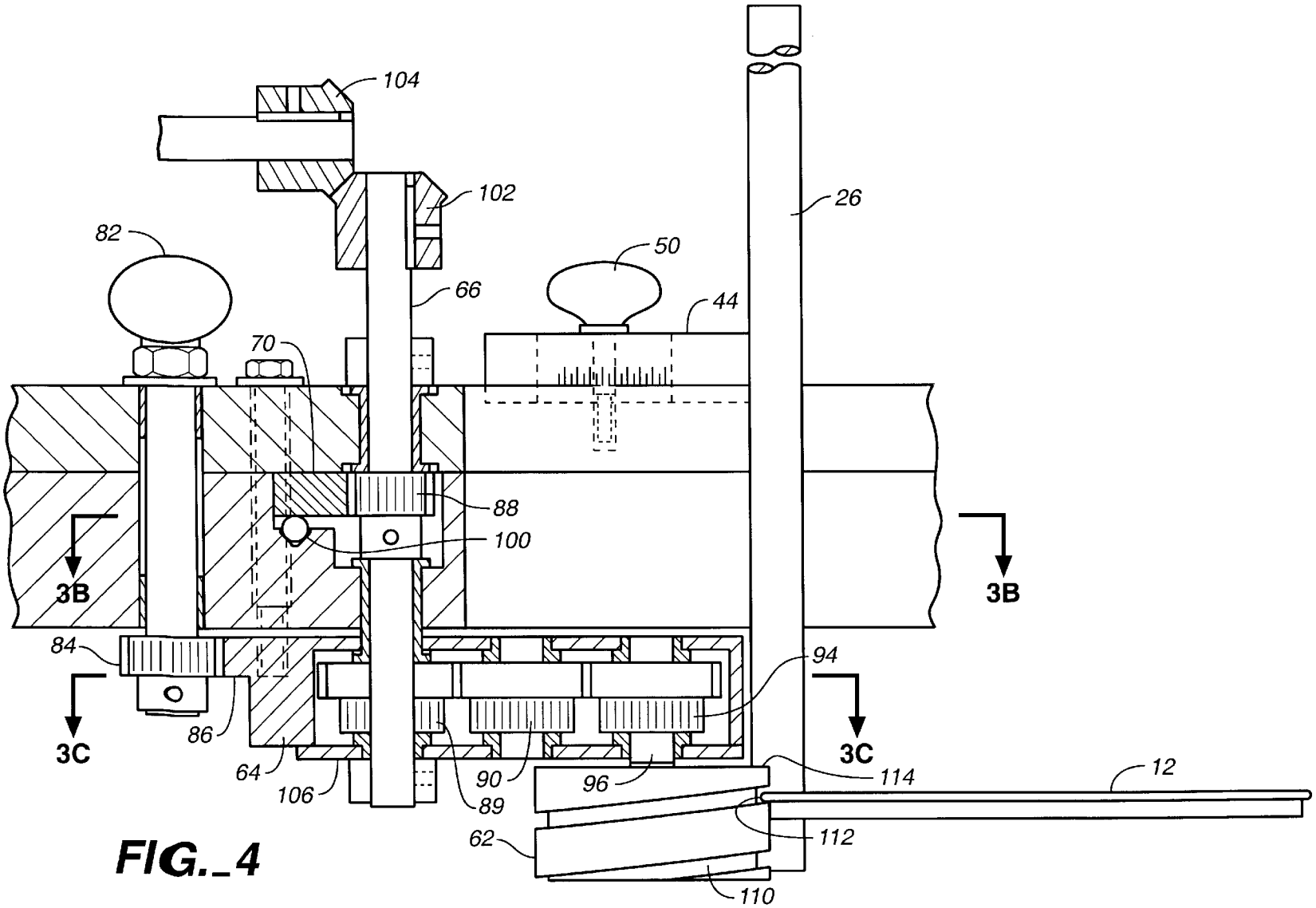
FIG. 4 is a section view showing the drive mechanism for rotating the feed screws.

Referring to FIG. 4, ring gear 70 is rotatably supported on bearings 100 within housing 30. Ring gear 70 engages the three pinion gears on its inside diameter and is driven by one of the driven pinion gears 88 inside one of the gear boxes. The shaft on this gear is connected through a shaft to a set of miter gears 102, 104, which are driven by a pneumatically operated clutch/brake unit (not shown). The clutch/brake unit is driven by a ¼ horsepower AC electric motor running continuously at 1725 revolutions per minute. Operation of the clutch/brake is controlled by a pneumatic control system mounted on the top of the lid dropper plate.

Driven gear 89 is also mounted on shaft 66, which extends through and supports crank arm 64. Idler gear 90 and output gear 94 intermesh and together form a gear box 106 within crank arm 64. Shaft 96 supports, in addition to output gear 94, one of the feed screws 62.

Each feed screw includes a helical groove 110, which is deep enough to receive and capture the outer rim 112 of lid 12. The groove captures and holds the upper lip of the lid. As the feed screw rotates one full revolution, the captured lid is lowered onto a paint can. To accomplish this, the helix on the feed screw has a pitch of ⅔ inches or 1½ inches helix per inch.

The feed screws are fabricated, preferably, from brass bar stock if the lid dropper is to be used with explosive materials. Since most paint manufacturers fill both water based paints and solvent based paints, the atmosphere can be explosive. Feed screws are made from brass to eliminate possible generation of sparks during contact with the can lid.

As feed screw 62 rotates, rim 112 is lowered along helical groove 110. The lids above the lowest most lid 12 (not shown) are supported on the upper shelf 114 of feed screw 62.

Figure 5:
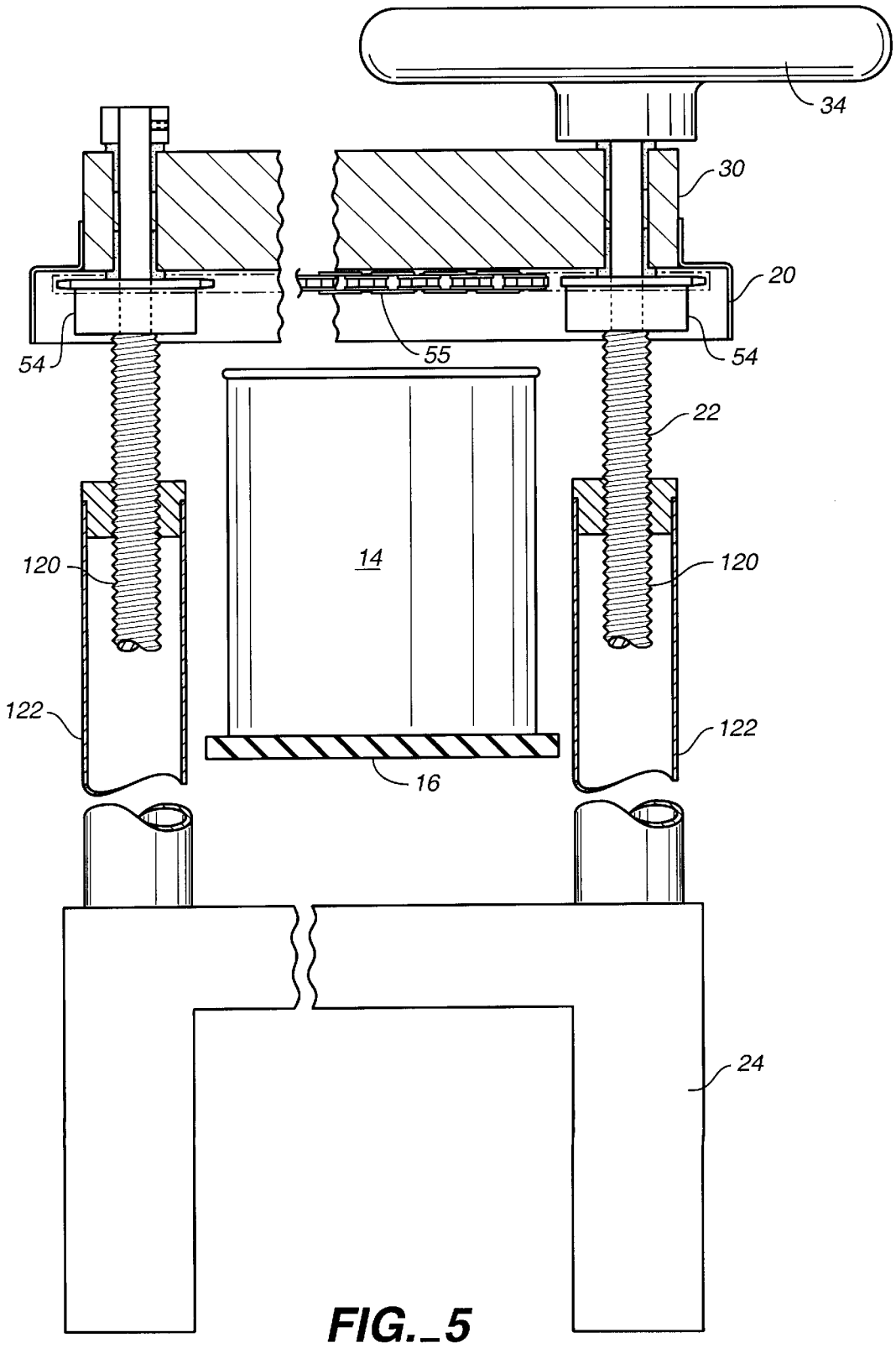
FIG. 5 is a sectional view showing the height adjustment jack screws.

Referring to FIG. 5, each jack screw 22 includes a threaded shaft 120, vertically supported within an upright tubular column 122. Columns 122 are mounted to frame 24. Sprockets 54 are secured to threaded shafts 120, which extend up through and support housing 30. Hand wheel 34 is mounted to one of the jack screws 22.

Initiation of the lid drop is triggered when a filled paint can 14 contacts a pneumatic three way valve (not shown) mounted on the paint can conveyor. When the valve is actuated, the clutch/brake makes one revolution then stops. It does not rotate again until the next filled paint can contacts the three way valve. Located on the input shaft that drives the ring gear is a feed screw cycling cam. This cam operates another three way valve, which resets the pneumatic system until the next can contacts the three way valve mounted on the paint can conveyor.

Since the height of paint cans varies from approximately 7 inches on gallon size cans to approximately 2 inches on ¼ pint cans, the new fully adjustable lid dropper of the present invention also has a height adjustment system built into the design. The height can be uniformly adjusted by turning a single large 8 inch diameter hand wheel. The hand wheel drives a sprocket that is connected by roller chain to three other sprockets at each corner of the lid dropper base plate. Each of the four sprockets are attached to a jack screw that is connected to a threaded tube. The tube is mounted to a frame onto which the paint can conveyor is mounted. With this sprocket and jack screw arrangement, when the hand wheel is turned, all four screws raise or lower the lid dropper assembly in unison to vary the height of the unit evenly.

Depending on the rate of filling and conveyor speed, the adjustable lid dropper can drop lids up to a rate of 150 lids per minute. A powered lid closer is located downstream of the lid dropper, which presses the lid onto the paint can.

The design of the present invention can be advantageously utilized in a method for the simple and rapid adjustment of a high speed lid dropper to accommodate lids and cans of various sizes, as follows. A sample lid is placed within the lid guide rods 26, which are radially adjusted to accommodate the sample lid and secured in position via thumb screws 50. Next, the feed screws 62 mounted on the pivotal crank arms 64 are adjusted via operatively coupled thumb screws 82 such that the helical groove 110 on the feed screws 62 receives and supports the outer rim of the sample lid. Lastly, the hand wheel 34 is rotated so as to uniformly adjust the height of the lid dropper assembly via the sprocket and jack screw arrangement discussed above relative to a can passing beneath the assembly. The foregoing steps can be accomplished with a minumum of time and effort, thereby avoiding costly delays.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

It is intended that the scope of the invention be defined by the Claims appended hereto when read and interpreted according to accepted legal principles such as the doctrine of equivalents and reversal of parts.

What is claimed is:

1. A lid dropper, comprising means for supporting a stack of lids in a generally vertical orientation;

a set of feed screws beneath said support means for separating the lowest most lid from the stack of lids and dropping the separated lid onto a can positioned beneath the feed screws;

means for vertically adjusting the set of feed screws and support means relative to a can positioned beneath the feed screws;

a radially adjustable crank arm for supporting each feed screw, each crank arm being pivotally mounted in a manner permitting the feed screw supported thereby to be adjusted radially so that the distance between the feed screws can be adjusted to accommodate different size lids; and a thumb screw operatively coupled to each crank arm to pivot the crank arm by rotation of the thumb screw, the thumb screws being individually rotatable to achieve individual adjustment of the crank arms.

2. The lid dropper of claim 1, further comprising means for holding each thumb screw in position after its associated crank arm is pivotally adjusted.

3. The lid dropper of claim 1, wherein the support means is radially adjustable to accommodate lids of varying sizes.

4. The lid dropper of claim 3, wherein the support means is radially adjustable independent of the feed screws.

5. The lid dropper of claim 1, wherein said means for vertical adjustment comprises a sprocket and jack screw arrangement for uniform adjustment of the set of feed screws and support means relative to a can positioned beneath the feed screws.

6. A lid dropper, comprising means for supporting a stack of lids in a generally vertical orientation;

a set of feed screws beneath said support means for separating the lowest most lid from the stack of lids and dropping the separated lid onto a can positioned beneath the feed screws;

a sprocket and jack screw arrangement for vertically adjusting the set of feed screws and support means relative to a can positioned beneath the feed screws, each sprocket in said arrangement operatively connected with a hand wheel for simultaneous adjustment of the height of each corresponding jack screw;

a radially adjustable crank arm for supporting each feed screw, each crank arm being pivotally mounted in a manner permitting the feed screw supported thereby to be adjusted radially so that the distance between the feed screws can be adjusted to accommodate different size lids; and a thumb screw operatively coupled to each crank arm to pivot the crank arm by rotation of the thumb screw, the thumb screws being individually rotatable to achieve individual adjustment of the crank arms.

7. The lid dropper of claim 6, further comprising means for holding each thumb screw in position after its associated crank arm is pivotally adjusted.

8. The lid dropper of claim 6, wherein the support means is radially adjustable to accommodate lids of varying sizes.

9. The lid dropper of claim 8, wherein the support means is radially adjustable independent of the feed screws.

10. A method of adjusting a lid dropper assembly to accommodate different size lids and cans, comprising:

radially adjusting and securing a plurality of guide rods surrounding a central opening in a top plate to a position proximal to a lid placed therebetween and over the central opening;

rotating a plurality of thumb screws operatively coupled with corresponding feed screws mounted on pivotal crank arms so as to radially position a helical groove in each of said feed screws to receive the rim of the lid and support the lid over the central opening for automated placement onto a can passing beneath said top plate; and turning a hand screw operatively coupled with a sprocket and jack screw arrangement supporting said lid dropper assembly to uniformly adjust the height of said assembly relative to the can passing beneath the central opening.

* * * * *